US007705661B2

(12) United States Patent
Li et al.

(10) Patent No.: US 7,705,661 B2
(45) Date of Patent: Apr. 27, 2010

(54) CURRENT CONTROL APPARATUS APPLIED TO TRANSISTOR

(75) Inventors: Tsung-Hsueh Li, Hsinchu (TW); Te-Hsun Huang, Hsinchu (TW)

(73) Assignee: Feature Integration Technology Inc., Chupei, Hsinchu (TW)

( * ) Notice: Subject to any disclaimer, the term of this patent is extended or adjusted under 35 U.S.C. 154(b) by 16 days.

(21) Appl. No.: 12/129,659

(22) Filed: May 29, 2008

(65) Prior Publication Data

US 2009/0184755 A1 Jul. 23, 2009

(30) Foreign Application Priority Data

Jan. 22, 2008 (TW) ..... 97102354 A

(51) Int. Cl.
*G05F 1/10* (2006.01)
*G05F 3/02* (2006.01)

(52) U.S. Cl. ..... 327/538; 327/541; 327/543

(58) Field of Classification Search ..... None
See application file for complete search history.

(56) References Cited

U.S. PATENT DOCUMENTS

| | | | | |
|---|---|---|---|---|
| 6,166,586 | A * | 12/2000 | Sanchez et al. | 327/538 |
| 6,448,844 | B1 * | 9/2002 | Cho | 327/538 |
| 6,985,028 | B2 * | 1/2006 | Lee et al. | 327/543 |
| 7,023,181 | B2 * | 4/2006 | Nakata | 322/28 |
| 7,477,094 | B2 * | 1/2009 | Date et al. | 327/538 |
| 2008/0024204 | A1 * | 1/2008 | Choy et al. | 327/538 |

* cited by examiner

*Primary Examiner*—Tuan Lam
(74) *Attorney, Agent, or Firm*—Winston Hsu

(57) ABSTRACT

The present invention provides a current control apparatus applied to a transistor. The transistor has a control terminal, a first terminal, and a second terminal. The current control apparatus includes a current control module, a first current mirror module, a second current mirror module, a current subtractor, and a current adjusting module. The current control apparatus provided by the present invention can be applied to a bipolar junction transistor (BJT) to prevent temperature measurement errors from occurring when using a dual current mode temperature measurement method to measure the temperature of the BJT.

25 Claims, 6 Drawing Sheets

CURRENT CONTROL APPARATUS APPLIED TO TRANSISTOR

BACKGROUND OF THE INVENTION

1. Field of the Invention

The present invention relates to a current control apparatus, and more particularly, to a current control apparatus that can be applied to a bipolar junction transistor (BJT) to prevent temperature measurement errors from occurring when using a dual current mode temperature measurement method to measure the temperature of the BJT.

2. Description of the Prior Art

Please refer to FIG. 1. FIG. 1 shows a simplified diagram of a bipolar junction transistor (BJT) 100 in accordance with prior art. As shown in FIG. 1, the BJT 100 has a base terminal, an emitter terminal, and a collector terminal. The base current Ib, the emitter current Ie, and the collector current Ic of the BJT 100 have the following connections:

$$Ib+Ie+Ic=0$$

$$Ie=-(\beta+1)Ic/\beta$$

In addition, a person of average skill in the pertinent art of the BJT should be able to understand about how to use a dual current mode temperature measurement method to measure the temperature of the BJT 100. The dual current mode temperature measurement method measures an emitter current Ie1 and another emitter current Ie2 of the BJT 100 at different times and calculates a temperature measurement result accordingly. However, since the temperature of the BJT is related to a ratio between a collector current Ic1 and another collector current Ic2, when β value of the BJT 100 becomes smaller in the advanced process and varies according to the current variation, the above temperature measurement method is unable to obtain the actual ratio between a collector current Ic1 and another collector current Ic2. Thus, the above condition will result in serious temperature measurement errors.

SUMMARY OF THE INVENTION

It is therefore one of the objectives of the present invention to provide a current control apparatus that can be applied to a transistor to prevent temperature measurement errors from occurring when using a dual current mode temperature measurement method to measure the temperature of the transistor, so as to solve the above problem.

In accordance with an embodiment of the present invention, a current control apparatus applied to a transistor is disclosed. The transistor has a control terminal, a first terminal, and a second terminal. The current control apparatus includes: a current control module, a first current mirror module, a second current mirror module, a current subtractor, and a current adjusting module. The current control module is utilized for outputting a current control signal. The first current mirror module has a first output terminal, a second output terminal, and an input terminal. The first output terminal is coupled to the first terminal of the transistor, and the input terminal is coupled to the current control module, and the first current mirror module is utilized for generating a first current mirror current and a second current mirror current, respectively, at the first output terminal and the second output terminal in accordance with the current control signal, wherein there is a predetermined current ratio between the first current mirror current and the second current mirror current, and the transistor generates a second current at the control terminal in accordance with the first current mirror current. The second current mirror module has a first terminal and a second terminal. The first terminal is coupled to the control terminal of the transistor, and the second current mirror module is utilized for generating a third current mirror current at the second terminal of the second current mirror module in accordance with the second current, wherein there is the predetermined current ratio between the second current and the third current mirror current. The current subtractor is coupled between the second output terminal of the first current mirror module and the second terminal of the second current mirror module. The current subtractor is utilized for generating a third current in accordance with the second current mirror current and the third current mirror current. The current adjusting module is coupled to the current subtractor, and utilized for adjusting the third current to a fourth current, wherein there is the fixed current ratio between the fourth current and the third current.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and the claims to refer to particular system components. As one skilled in the art will appreciate, manufacturers may refer to a component by different names. This document does not intend to distinguish between components that differ in name but not function. In the following discussion and in the claims, the terms "include", "including", "comprise", and "comprising" are used in an open-ended fashion, and thus should be interpreted to mean "including, but not limited to . . . " The terms "couple" and "coupled" are intended to mean either an indirect or a direct electrical connection. Thus, if a first device couples to a second device, that connection may be through a direct electrical connection, or through an indirect electrical connection via other devices and connections.

Figure 1:
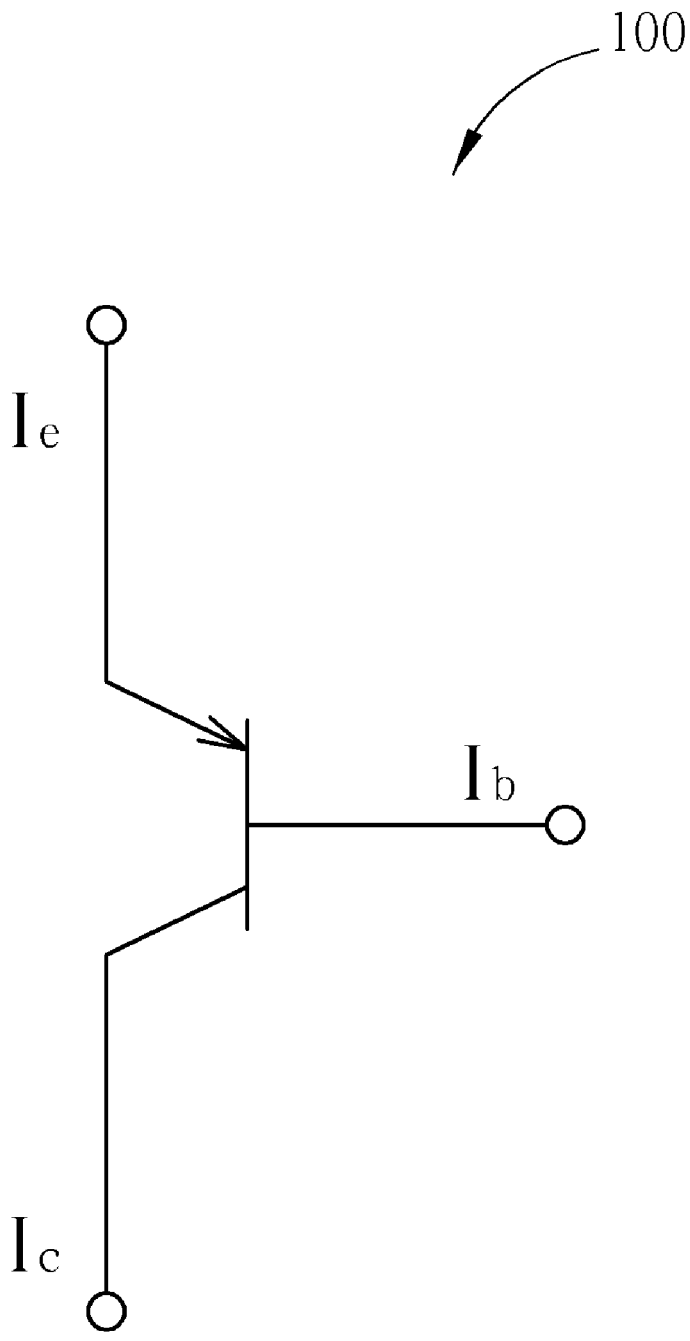
FIG. 1 PRIOR ART
FIG. 1 shows a simplified diagram of a bipolar junction transistor (BJT) in accordance with prior art.
Figure 2:
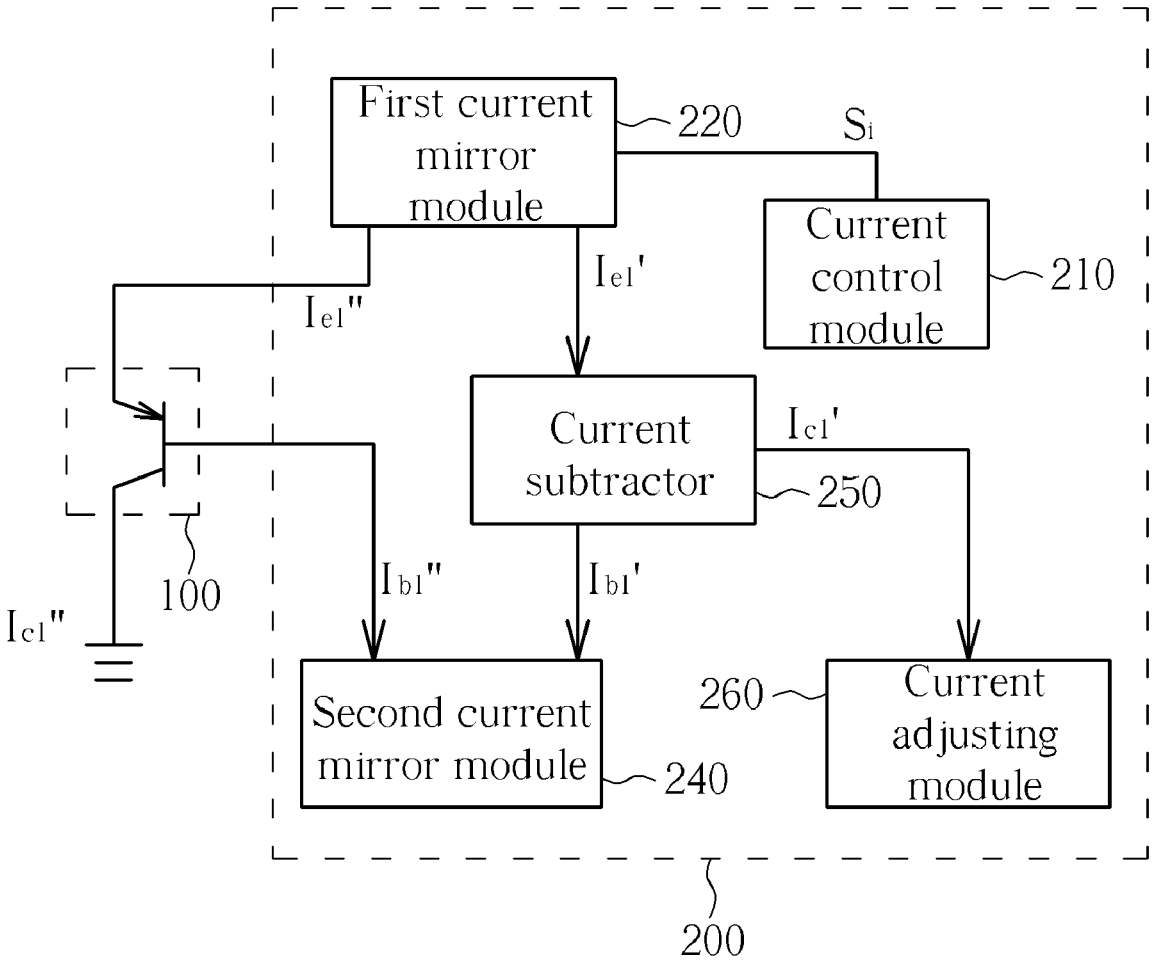
FIG. 2 shows a simplified block diagram of a current control apparatus applied to a BJT in accordance with an embodiment of the present invention.

Please refer to FIG. 2. FIG. 2 shows a simplified block diagram of a current control apparatus 200 applied to a bipolar junction transistor (BJT) 100 in accordance with an embodiment of the present invention. As shown in FIG. 2, the BJT 100 has a control terminal (i.e., a base terminal), a first terminal (i.e., an emitter terminal), and a second terminal (i.e., a collector terminal). The current control apparatus 200 comprises: a current control module 210, a first current mirror module 220, a second current mirror module 240, a current subtractor 250, and a current adjusting module 260. The current control module 210 is utilized for outputting a current control signal Si. The first current mirror module 220 has a first output terminal, a second output terminal, and an input terminal, wherein the first output terminal is coupled to the emitter terminal of the BJT 100, and the input terminal is coupled to the current control module 210. The first current mirror module 220 is utilized for generating a first current mirror current Ie1" and a second current mirror current Ie1', respectively, at the first output terminal and the second output terminal in accordance with the current control signal Si, wherein there is a predetermined current ratio between the first current mirror current Ie1" and the second current mirror current Ie1', and the BJT 100 generates a second current Ib1" at the base terminal in accordance with the first current mirror current Ie1". The second current mirror module 240 has a first terminal and a second terminal, and a third terminal. The first terminal is coupled to the base terminal of the BJT 100, and the second current mirror module 240 is utilized for generating a third current mirror current Ib1' at the second terminal of the second current mirror module 240 in accordance with the second current Ib1", wherein there is the predetermined current ratio between the second current Ib1" and the third current mirror current Ib1'. The current subtractor 250 is coupled between the second output terminal of the first current mirror module 220 and the second terminal of the second current mirror module 240. The current subtractor 250 is utilized for generating a third current Ic1' in accordance with the second current mirror current Ie1' and the third current mirror current Ib1'. The current adjusting module 260 is coupled to the current subtractor 250, and utilized for adjusting the third current Ic1' to a fourth current Ic2', wherein there is the fixed current ratio between the fourth current Ic2' and the third current Ic1'. In addition, please note that the above embodiment is only for illustrative purposes and is not meant to be a limitation of the present invention. Next, this document will illustrate details of the circuit configuration and the operational scheme of the current control apparatus 200 in the present invention.

Figure 3:
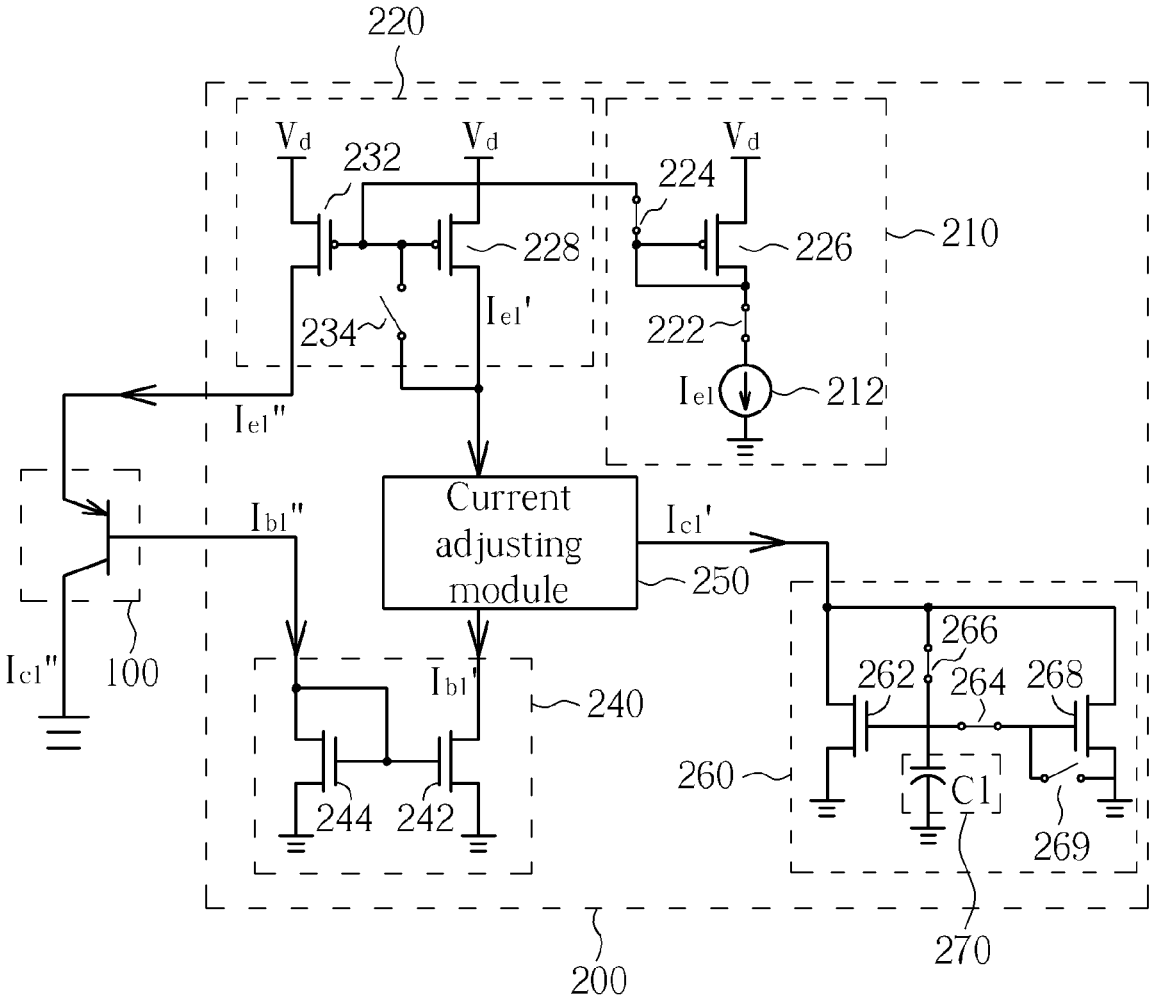
FIG. 3 shows a simplified circuit configuration diagram of the current control apparatus shown in FIG. 2 in accordance with a first embodiment of the present invention.
Figure 4:
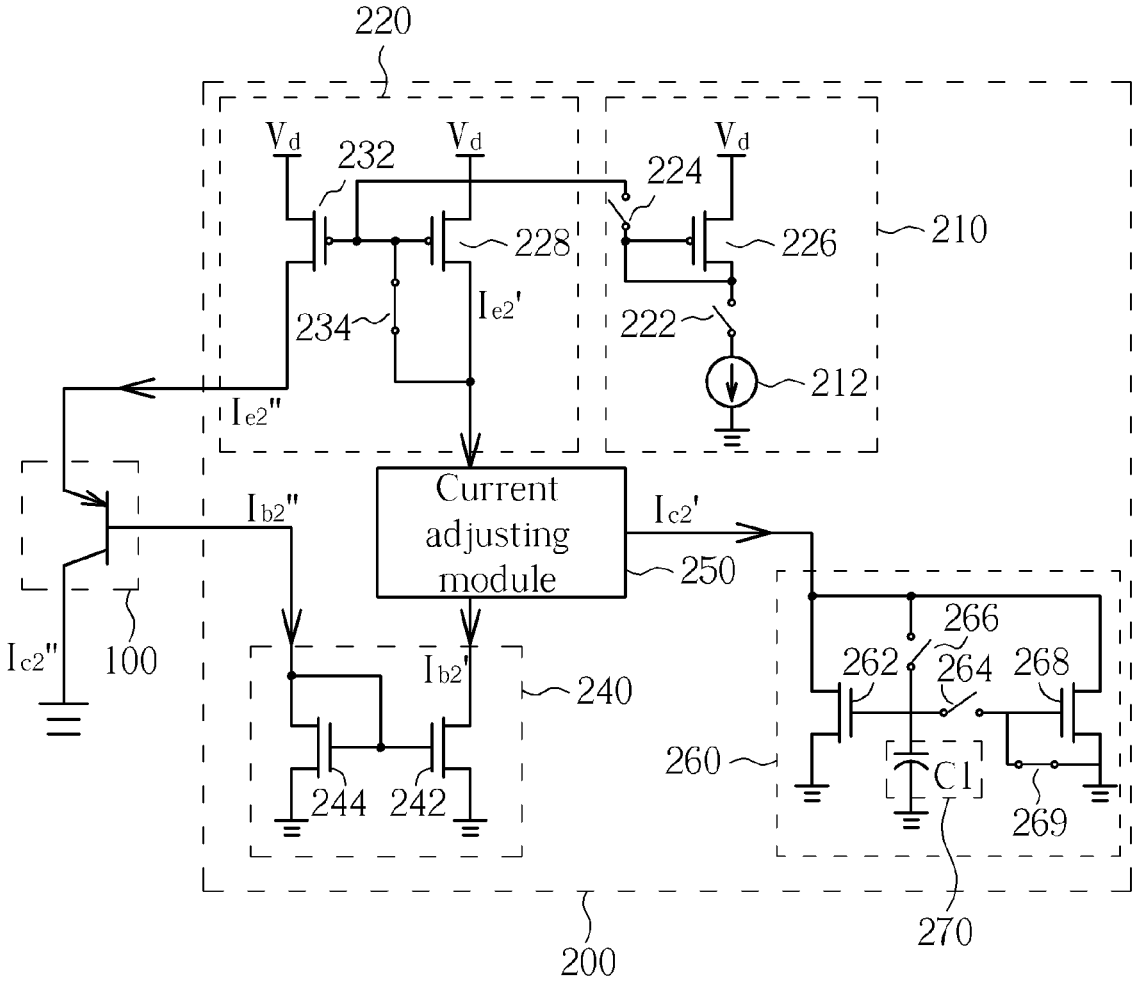
FIG. 4 shows a simplified circuit configuration diagram of the current control apparatus shown in FIG. 2 in accordance with a first embodiment of the present invention.

Please refer to FIG. 3 and FIG. 4. FIG. 3 and FIG. 4 show a simplified circuit configuration diagram of the current control apparatus 200 shown in FIG. 2 in accordance with a first embodiment of the present invention. As shown in FIG. 3 and FIG. 4, the current control module 210 comprises a current source 212, a first switch element 222, a second switch element 224, and a first transistor switch 226. The current source 212 is coupled to a first voltage source (such as a ground voltage source) and utilized for providing a first current Ie1 as the current control signal Si shown in FIG. 2. The first switch element 222 has a control terminal, a first terminal, and a second terminal, wherein the second terminal is coupled to the current source 212. The second switch element 224 has a control terminal, a first terminal, and a second terminal. The first transistor switch 226 has a control terminal (i.e., a gate terminal) coupled to the second terminal of the second switch element 224, a first terminal (i.e., a source terminal) coupled to a second voltage source, and a second terminal (i.e., a drain terminal) coupled to the first terminal of the first switch element 222 and the control terminal of the first transistor switch 226. However, please note that the above embodiment is only for illustrative purposes and is not meant to be a limitation of the present invention. For example, the current control module 210 can also be a bias voltage source utilized for providing a bias voltage as the current control signal Si.

The first current mirror module 220 comprises a second transistor switch 228, a third transistor switch 232, and a third switch element 234. The second transistor switch 228 has a control terminal (i.e., a gate terminal) coupled to the first terminal of the second switch element 224, a first terminal (i.e., a source terminal) coupled to the second voltage source Vd, and a second terminal (i.e., a drain terminal) coupled to the current subtractor 250. The third transistor switch 232 has a control terminal (i.e., a gate terminal) coupled to the first terminal of the second switch element 224 and the control terminal of the second transistor switch 228, a first terminal (i.e., a source terminal) coupled to the second voltage source Vd, and a second terminal (i.e., a drain terminal) coupled to the first terminal of the BJT 100. The third switch element 234 has a control terminal, a first terminal coupled to the control terminal of the second transistor switch 228, and a second terminal coupled to the second terminal of the second transistor switch 228.

The second current mirror module 240 comprises a fourth transistor switch 242 and a fifth transistor switch 244.

The fourth transistor switch 242 has a control terminal (i.e., a gate terminal), a first terminal (i.e., a source terminal) coupled to a first voltage source, and a second terminal (i.e., a drain terminal) coupled to the current subtractor 250.

The fifth transistor switch 244 has a control terminal (i.e., a gate terminal) coupled to the control terminal of the fourth transistor switch 242, a first terminal (i.e., a source terminal) coupled to the first voltage source, and a second terminal (i.e., a drain terminal) coupled to the second terminal of the second current mirror module 240 and the control terminal of the BJT 100.

The current adjusting module 260 comprises a sixth transistor switch 262, a fourth switch element 264, a fifth switch element 266, a seventh transistor switch 268, a sixth switch element 269, and a voltage memorizing module 270. The sixth transistor switch 262 has a control terminal (i.e., a gate terminal), a first terminal (i.e., a source terminal) coupled to the first voltage source, and a second terminal (i.e., a drain terminal) coupled to the current subtractor 250. The fourth switch element 264 has a control terminal, a first terminal, and a second terminal coupled to the control terminal of the sixth transistor switch 262. The fifth switch element 266 has a control terminal, a first terminal coupled to the second terminal of the sixth transistor switch 262, and a second terminal coupled to the control terminal of the sixth transistor switch 262. The seventh transistor switch 268 has a control terminal (i.e., a gate terminal) coupled to the first terminal of the fourth switch element 264, a first terminal (i.e., a source terminal) coupled to the first voltage source, and a second terminal (i.e., a drain terminal) coupled to the second terminal of the sixth transistor switch 262 and the first terminal of the fifth switch element 266. The sixth switch element 269 has a control terminal, a first terminal coupled to the control terminal of the seventh transistor switch 268, and a second terminal coupled to the first voltage source. The voltage memorizing module 270 is coupled between the first voltage source and the control terminal of the sixth transistor switch 262. There is a fixed ratio N/(M−N) between the size of the sixth transistor switch 262 and size of the seventh transistor switch 268. Thus, the present invention can allow the fixed current ratio to be between the fourth current Ic2' and the third current Ic1' equal to N/M.

In addition, the first transistor switch 226, the second transistor switch 228, and the third transistor switch 232 element are P-type FETs (such as PMOSFETs) in this embodiment, and the fourth transistor switch 242, the fifth transistor switch 244, the sixth transistor switch 262, and the seventh transistor switch 268 are N-type FETs (such as NMOSFETs). The voltage memorizing module 270 is a capacitor in this embodiment. However, please note that the above embodiment is only for illustrative purposes and is not meant to be a limitation of the present invention. Next, the operating process flow of the current control apparatus 200 in the present invention will be illustrated. When the current control apparatus 200 operates during a first operation period, the first switch element 222, the second switch element 224, the fourth switch element 264, and the fifth switch element 266 are in a conducting state, and the third switch element 234 and the sixth switch element 269 are in an non-conducting state, as shown in FIG. 3. In this way, the first current mirror module 220 generates a first current mirror current Ie1" and a second current mirror current Ie1' at the first output terminal and the second output terminal in accordance with the first current Ie1, respectively, wherein a predetermined current ratio between the first current mirror current Ie1" and the second current mirror current Ie1' is 1:1, and the BJT 100 generates a second current Ib1" at the base terminal in accordance with the first current mirror current Ie1". Next, the second current mirror module 240 generates a third current mirror current Ib1' at the second terminal of the second current mirror module 240 in accordance with the second current Ib1", wherein there is the predetermined current ratio (i.e., 1:1) between the second current Ib1" and the third current mirror current Ib1'. Next, the current subtractor 250 generates a third current Ic1' in accordance with the second current mirror current Ie1' and the third current mirror current Ib1'. Then, when the current control apparatus 200 operates during a second operation period, the first switch element 222, the second switch element 224, the fourth switch element 264, and the fifth switch element 266 are in a non-conducting state, and the third switch element 234 and the sixth switch element 269 are in a conducting state, as shown in FIG. 4. In this way, the current adjusting module 260 adjusts the third current Ic1' to a fourth current Ic2', wherein a fixed current ratio between the fourth current Ic2' and the third current Ic1' is N:M, and the fourth current Ic2' will be a control current for the entire circuit of the current control apparatus 200. In the meantime, the entire circuit of the current control apparatus 200 will automatically converge to generate a second current mirror current Ie2', a first current mirror current Ie2", a third current mirror current Ib2', and a second current Ib2" that are appropriate, and the BJT 100 will generate a collector current Ic2" at the same time.

Figure 5:
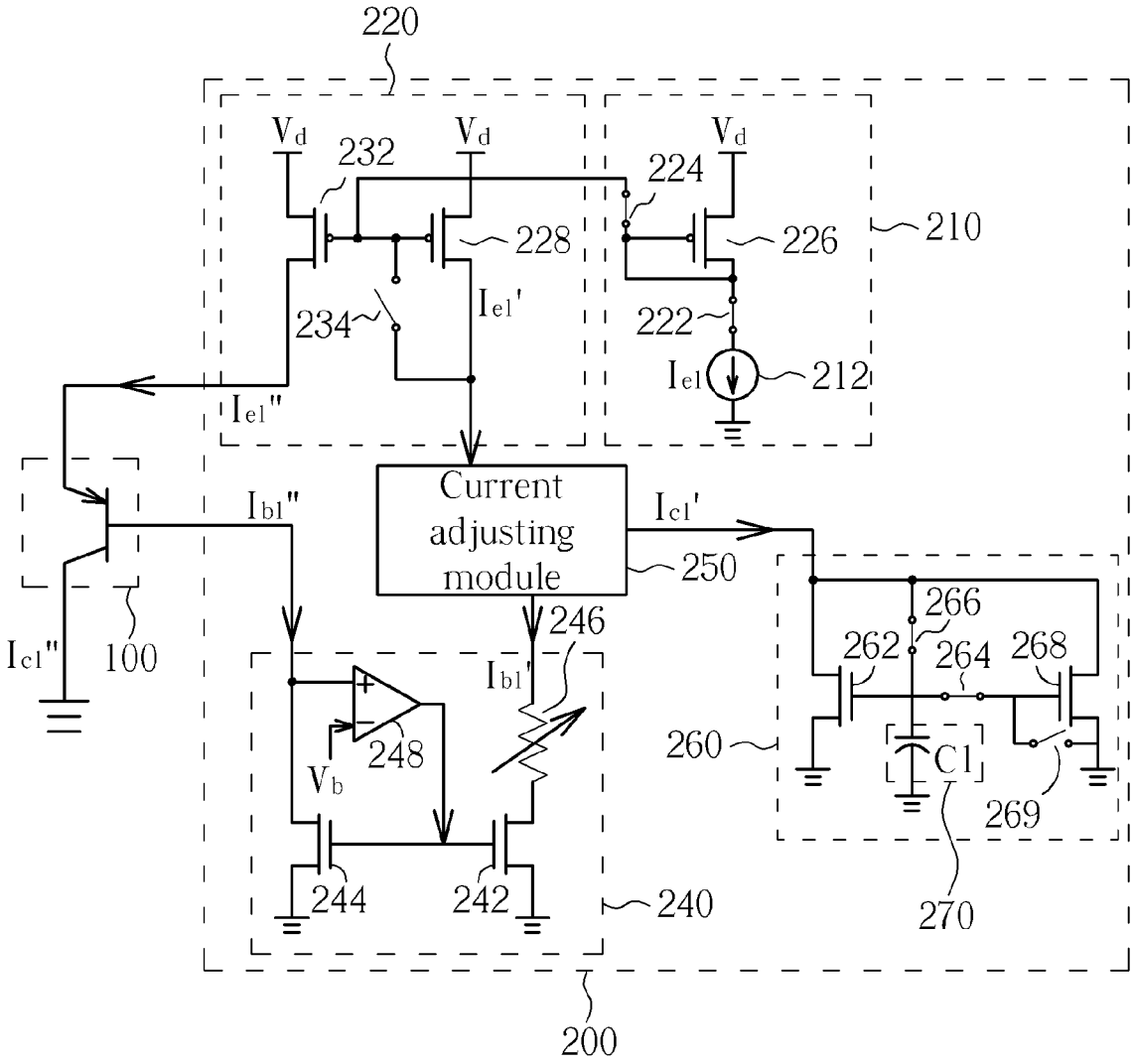
FIG. 5 shows a simplified circuit configuration diagram of the current control apparatus shown in FIG. 2 in accordance with a second embodiment of the present invention
Figure 6:
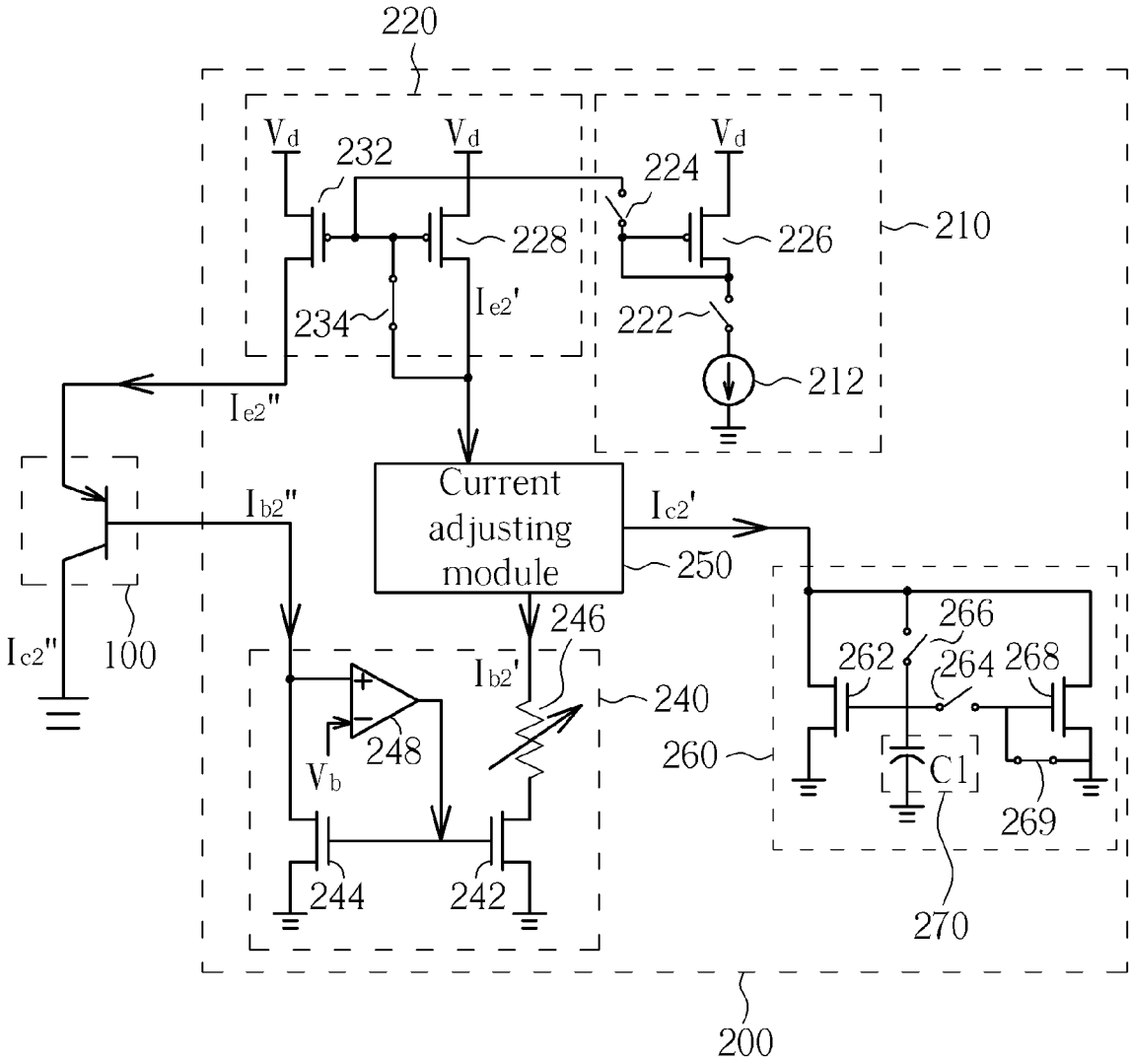
FIG. 6 shows a simplified circuit configuration diagram of the current control apparatus shown in FIG. 2 in accordance with a second embodiment of the present invention.

Please refer to FIG. 5 and FIG. 6, which show a simplified circuit configuration diagram of the current control apparatus 200 shown in FIG. 2 in accordance with a second embodiment of the present invention. The current control apparatus 200 of the second embodiment is similar to the current control apparatus 200 of the first embodiment, and thus the element symbols of the current control apparatus 200 shown in FIG. 5 and FIG. 6 are the same as those of the current control apparatus 200 shown in FIG. 3 and FIG. 4. Further explanation of the details and operations of the same circuit elements in the current control apparatus 200 are omitted herein for the sake of brevity. Differences between the current control apparatus 200 shown in FIG. 5 and FIG. 6 and the current control apparatus 200 shown in FIG. 3 and FIG. 4 are shown in FIG. 5 and FIG. 6. The second current mirror module 240 further comprises a variable resistance unit 246 and a bias voltage control module 248. The variable resistance unit 246 is coupled between the current subtractor 250 and the second terminal of the fourth transistor switch 242, and utilized for controlling voltage level of the second terminal of the fourth transistor switch 242 to be identical with voltage level of the second terminal of the fifth transistor switch 244. The bias voltage control module 248 is coupled between the control terminal of the BJT 100 and the control terminal of the fourth transistor switch 242, and utilized for maintaining a fixed voltage level at the control terminal of the BJT 100. The bias voltage control module 248 is an operational amplifier, and the operational amplifier comprises a first terminal coupled to the control terminal of the BJT 100, a second terminal coupled to a bias voltage signal Vb, and an output terminal coupled to the control terminal of the fourth transistor switch 242.

Briefly summarized, the voltage level clamping circuit disclosed by the present invention can be applied to a BJT to prevent temperature measurement errors from occurring when using a dual current mode temperature measurement method to measure the temperature of the BJT.

Those skilled in the art will readily observe that numerous modifications and alterations of the device and method may be made while retaining the teachings of the invention.

What is claimed is:

1. A current control apparatus applied to a transistor having a control terminal, a first terminal, and a second terminal, the current control apparatus comprising:

a current control module, for outputting a current control signal;

a first current mirror module, having a first output terminal, a second output terminal, and an input terminal, the first output terminal being coupled to the first terminal of the transistor, the input terminal being coupled to the current control module, and the first current mirror module utilized for generating a first current mirror current and a second current mirror current respectively at the first output terminal and the second output terminal in accordance with the current control signal, wherein there is a predetermined current ratio between the first current mirror current and the second current mirror current, and the transistor generates a second current at the control terminal in accordance with the first current mirror current;

a second current mirror module, having a first terminal and a second terminal, the first terminal coupled to the control terminal of the transistor, and the second current mirror module utilized for generating a third current mirror current at the second terminal of the second current mirror module in accordance with the second current, wherein there is a predetermined current ratio between the second current and the third current mirror current;

a current subtractor, coupled between the second output terminal of the first current mirror module and the second terminal of the second current mirror module, utilized for generating a third current in accordance with the second current mirror current and the third current mirror current; and a current adjusting module, coupled to the current subtractor, utilized for adjusting the third current to a fourth current, wherein there is a fixed current ratio between the fourth current and the third current.

2. The current control apparatus of claim 1, wherein the current control module comprises:

a current source, coupled to a first voltage source, utilized for providing a first current as the current control signal;

a first switch element, having a control terminal, a first terminal, and a second terminal, wherein the second terminal is coupled to the current source;

a second switch element, having a control terminal, a first terminal, and a second terminal; and a first transistor switch, having a control terminal coupled to the second terminal of the second switch element, a first terminal coupled to a second voltage source, and a second terminal coupled to the first terminal of the first switch element and the control terminal of the first transistor switch.

3. The current control apparatus of claim 2, wherein the first current mirror module comprises:

a second transistor switch, having a control terminal coupled to the first terminal of the second switch element, a first terminal coupled to the second voltage source, and a second terminal coupled to the current subtractor;

a third transistor switch, having a control terminal coupled to the first terminal of the second switch element and the control terminal of the second transistor switch, a first terminal coupled to the second voltage source, and a second terminal coupled to the first terminal of the transistor; and a third switch element, having a control terminal, a first terminal coupled to the control terminal of the second transistor switch, and a second terminal coupled to the second terminal of the second transistor switch.

4. The current control apparatus of claim 3, wherein when the current control apparatus operates during a first operation period, the first switch element and the second switch element are in a conducting state, and the third switch element is in an non-conducting state; and when the current control apparatus operates during a second operation period, the first switch element and the second switch element are in an non-conducting state, and the third switch element is in a conducting state.

5. The current control apparatus of claim 3, wherein the first transistor switch, the second transistor switch, and the third transistor switch are P-type FETs.

6. The current control apparatus of claim 3, wherein the fixed current ratio substantially equals N/M, and the current adjusting module comprises:

a fourth transistor switch, having a control terminal, a first terminal coupled to the first voltage source, and a second terminal coupled to the current subtractor;

a fourth switch element, having a control terminal, a first terminal, and a second terminal coupled to the control terminal of the fourth transistor switch;

a fifth switch element, having a control terminal, a first terminal coupled to the second terminal of the fourth transistor switch, and a second terminal coupled to the control terminal of the fourth transistor switch;

a fifth transistor switch, having a control terminal coupled to the first terminal of the fourth switch element, a first terminal coupled to the first voltage source, and a second terminal coupled to the second terminal of the fourth transistor switch and the first terminal of the fifth switch element;

a sixth switch element, having a control terminal, a first terminal coupled to the control terminal of the fifth transistor switch, and a second terminal coupled to the first voltage source; and a voltage memorizing module, coupled between the first voltage source and the control terminal of the fourth transistor switch;

wherein there is a fixed ratio N/(M-N) between a size of the fourth transistor switch and a size of the fifth transistor switch.

7. The current control apparatus of claim 6, wherein when the current control apparatus operates during a first operation period, the first switch element, the second switch element, the fourth switch element, and the fifth switch element are in a conducting state, and the third switch element and the sixth switch element are in an non-conducting state; and when the current control apparatus operates during a second operation period, the first switch element, the second switch element, the fourth switch element, and the fifth switch element are in a non-conducting state, and the third switch element and the sixth switch element are in a conducting state.

8. The current control apparatus of claim 6, wherein the voltage memorizing module is a capacitor.

9. The current control apparatus of claim 6, wherein the fourth transistor switch and the fifth transistor switch are N-type FETs.

10. The current control apparatus of claim 1, wherein the second current mirror module comprises:

a first transistor switch, having a control terminal, a first terminal coupled to a first voltage source, and a second terminal coupled to the current subtractor; and a second transistor switch, having a control terminal coupled to the control terminal of the first transistor switch, a first terminal coupled to the first voltage source, and a second terminal coupled to the second terminal of the second current mirror module and the control terminal of the transistor.

11. The current control apparatus of claim 10, wherein the first transistor switch and the second transistor switch are N-type FETs.

12. The current control apparatus of claim 10, wherein the second current mirror module further comprises:

a variable resistance unit, coupled between the current subtractor and the second terminal of the first transistor switch, utilized for controlling a voltage level of the second terminal of the first transistor switch to be identical to a voltage level of the second terminal of the second transistor switch; and a bias voltage control module, coupled between the control terminal of the transistor and the control terminal of the first transistor switch, utilized for maintaining a fixed voltage level at the control terminal of the transistor.

13. The current control apparatus of claim 12, wherein the bias voltage control module is an operational amplifier, and the operational amplifier comprises:

a first terminal, coupled to the control terminal of the transistor;

a second terminal, coupled to a bias voltage signal; and an output terminal, coupled to the control terminal of the first transistor switch.

14. The current control apparatus of claim 12, wherein the fixed current ratio substantially equals N/M, and the current adjusting module comprises:

a third transistor switch, having a control terminal, a first terminal coupled to the first voltage source, and a second terminal coupled to the current subtractor;

a first switch element, having a control terminal, a first terminal, and a second terminal coupled to the control terminal of the third transistor switch;

a second switch element, having a control terminal, a first terminal coupled to the second terminal of the third transistor switch, and a second terminal coupled to the control terminal of the third transistor switch;

a fourth transistor switch, having a control terminal coupled to the first terminal of the first switch element, a first terminal coupled to the first voltage source, and a second terminal coupled to the second terminal of the third transistor switch and the first terminal of the second switch element;

a third switch element, having a control terminal, a first terminal coupled to the control terminal of the fourth transistor switch, and a second terminal coupled to the first voltage source; and a voltage memorizing module, coupled between the first voltage source and the control terminal of the third transistor switch;

wherein there is a fixed ratio N/(M-N) between size of the third transistor switch and size of the fourth transistor switch.

15. The current control apparatus of claim 14, wherein when the current control apparatus operates during a first operation period, the first switch element and the second switch element are in a conducting state, and the third switch element is in an non-conducting state; and when the current control apparatus operates during a second operation period, the first switch element and the second switch element are in an non-conducting state, and the third switch element is in a conducting state.

16. The current control apparatus of claim 14, wherein the voltage memorizing module is a capacitor.

17. The current control apparatus of claim 14, wherein the third transistor switch and the fourth transistor switch are N-type FETs.

18. The current control apparatus of claim 1, wherein the transistor is a bipolar junction transistor (BJT).

19. The current control apparatus of claim 1, wherein the current control module is a bias voltage source, utilized for providing a bias voltage as the current control signal.

20. The current control apparatus of claim 19, wherein the first current mirror module comprises:

a first transistor switch, having a control terminal coupled to the bias voltage source, a first terminal coupled to the second voltage source, and a second terminal coupled to the current subtractor;

a second transistor switch, having a control terminal coupled to the bias voltage source and the control terminal of the first transistor switch, a first terminal coupled to the second voltage source, and a second terminal coupled to the first terminal of the transistor; and a first switch element, having a control terminal, a first terminal coupled to the control terminal of the first transistor switch, and a second terminal coupled to the second terminal of the first transistor switch.

21. The current control apparatus of claim 20, wherein when the current control apparatus operates during a first operation period, the first switch element is in a non-conducting state; and when the current control apparatus operates during a second operation period, the first switch element is in a conducting state.

22. The current control apparatus of claim 20, wherein the fixed current ratio substantially equals N/M, and the current adjusting module comprises:

a third transistor switch, having a control terminal, a first terminal coupled to the first voltage source, and a second terminal coupled to the current subtractor;

a second switch element, having a control terminal, a first terminal, and a second terminal coupled to the control terminal of the third transistor switch;

a third switch element, having a control terminal, a first terminal coupled to the second terminal of the third transistor switch, and a second terminal coupled to the control terminal of the third transistor switch;

a fourth transistor switch, having a control terminal coupled to the first terminal of the second switch element, a first terminal coupled to the first voltage source, and a second terminal coupled to the second terminal of the third transistor switch and the first terminal of the third switch element;

a fourth switch element, having a control terminal, a first terminal coupled to the control terminal of the fourth transistor switch, and a second terminal coupled to the first voltage source; and a voltage memorizing module, coupled between the first voltage source and the control terminal of the third transistor switch;

wherein there is a fixed ratio N/(M-N) between a size of the third transistor switch and a size of the fourth transistor switch.

23. The current control apparatus of claim 22, wherein when the current control apparatus operates during a first operation period, the second switch element and the third switch element are in a conducting state, and the first switch element and the fourth switch element are in a non-conducting state; and when the current control apparatus operates during a second operation period, the second switch element and the third switch element are in a non-conducting state, and the first switch element and the fourth switch element are in a conducting state.

24. The current control apparatus of claim 19, wherein the second current mirror module comprises:

a first transistor switch, having a control terminal, a first terminal coupled to a first voltage source, and a second terminal coupled to the current subtractor; and a second transistor switch, having a control terminal coupled to the control terminal of the first transistor switch, a first terminal coupled to the first voltage source, and a second terminal coupled to the second terminal of the second current mirror module and the control terminal of the transistor.

25. The current control apparatus of claim 24, wherein the second current mirror module further comprises:

a variable resistance unit, coupled between the current subtractor and the second terminal of the first transistor switch, utilized for controlling voltage level of the second terminal of the first transistor switch to be substantially identical to a voltage level of the second terminal of the second transistor switch; and a bias voltage control module, coupled between the control terminal of the transistor and the control terminal of the first transistor switch, utilized for maintaining a fixed voltage level at the control terminal of the transistor.

* * * * *